US009824842B2

(12) United States Patent
Abad et al.

(10) Patent No.: US 9,824,842 B2
(45) Date of Patent: Nov. 21, 2017

(54) WIRE IN AIR SPLIT FUSE WITH BUILT-IN ARC QUENCHER

(71) Applicant: LITTELFUSE, INC., Chicago, IL (US)

(72) Inventors: Redante Abad, Batangas (PH); Edwin Aberin, Muntinlupa (PH); Ped Peterson Bruan, Batangas (PH)

(73) Assignee: Littelfuse, Inc., Chicago, IL (US)

( * ) Notice: Subject to any disclaimer, the term of this patent is extended or adjusted under 35 U.S.C. 154(b) by 0 days.

(21) Appl. No.: 15/003,364

(22) Filed: Jan. 21, 2016

(65) Prior Publication Data

US 2016/0217960 A1 Jul. 28, 2016

Related U.S. Application Data

(60) Provisional application No. 62/106,378, filed on Jan. 22, 2015.

(51) Int. Cl.

| | |
|---|---|
| ***H01H 85/38*** | (2006.01) |
| ***H01H 85/143*** | (2006.01) |
| ***H01H 85/165*** | (2006.01) |
| ***H01H 85/055*** | (2006.01) |
| *H01H 85/18* | (2006.01) |
| *H01H 85/041* | (2006.01) |

(52) U.S. Cl.

CPC ..... *H01H 85/38* (2013.01); *H01H 85/055* (2013.01); *H01H 85/143* (2013.01); *H01H 85/165* (2013.01); *H01H 85/18* (2013.01); *H01H 2085/0414* (2013.01); *H01H 2085/383* (2013.01)

(58) Field of Classification Search

CPC .... H01H 85/38; H01H 85/165; H01H 85/143; H01H 85/055; H01H 2085/383; H01H 85/18; H01H 2085/0414

USPC ..... 337/227

See application file for complete search history.

(56) References Cited

U.S. PATENT DOCUMENTS 441,933 A * 12/1890 Cartwright ..... H01H 85/38 337/278
480,802 A * 8/1892 Blathy ..... H01H 85/38 337/278
1,700,582 A * 1/1929 Brown ..... H01H 85/044 337/201

(Continued)

OTHER PUBLICATIONS

International Search Report and Written Opinion, dated Mar. 24, 2016, in corresponding PCT/US2016/014421.

*Primary Examiner* — Anatoly Vortman

(57) ABSTRACT

A circuit protection device including a housing having a top section mounted to a bottom section, a first arc barrier extending from the bottom section, a second arc barrier extending from the top section, the top and bottom sections mounted together to define a cavity between the first arc barrier separated a distance from the second arc barrier, a first terminal and a second terminal secured to the bottom section, and a fuse element comprising a body of metallic material arranged in one of a plurality of geometric configurations mounted within the top section and the bottom section of the housing, extending through the first arc barrier and the second arc barrier and connected to the first and second terminals, wherein the first and second arc barriers resist arcing upon activation of the fuse and the fuse element melts upon occurrence of an overcurrent condition.

19 Claims, 10 Drawing Sheets

(56) References Cited

U.S. PATENT DOCUMENTS

| | | | | | |
|---|---|---|---|---|---|
| 2,734,110 | A * | 2/1956 | Jacobs, Jr. | H01H 85/38 | 337/281 |
| 3,601,737 | A * | 8/1971 | Baird | H01H 85/055 | 337/159 |
| 4,511,875 | A * | 4/1985 | Arikawa | H01H 85/0411 | 337/186 |
| 4,608,548 | A | 8/1986 | Borzoni | | |
| 4,703,299 | A * | 10/1987 | Vermij | H01H 85/0418 | 337/158 |
| 4,894,633 | A * | 1/1990 | Holtfreter | H01H 85/0411 | 337/201 |
| 5,101,187 | A * | 3/1992 | Yuza | H01H 85/0417 | 337/255 |
| 5,130,688 | A * | 7/1992 | Van Rietschoten | H01H 85/38 | 337/231 |
| 6,407,657 | B1 * | 6/2002 | Oh | H01H 85/0417 | 337/181 |
| 6,542,064 | B2 * | 4/2003 | Endo | H01H 85/0417 | 337/234 |
| 8,629,749 | B2 * | 1/2014 | Chiu | H01H 85/165 | 337/159 |
| 2007/0075822 | A1 | 4/2007 | Pachla et al. | | |
| 2008/0297301 | A1 | 12/2008 | Onken et al. | | |
| 2009/0027155 | A1 * | 1/2009 | Arikawa | H01H 85/38 | 337/228 |
| 2011/0279218 | A1 | 11/2011 | Salonga et al. | | |
| 2013/0313008 | A1 * | 11/2013 | Steiner | H01H 85/0039 | 174/260 |

* cited by examiner

WIRE IN AIR SPLIT FUSE WITH BUILT-IN ARC QUENCHER

CROSS REFERENCE TO RELATED APPLICATION

This application claims priority to U.S. Provisional Patent Application No. 62/106,378, filed Jan. 22, 2015, the entirety of which is hereby incorporated by reference.

FIELD OF THE DISCLOSURE

This disclosure relates generally to the field of circuit protection devices and more particularly to high-current fuses.

BACKGROUND OF THE DISCLOSURE

Fuses can be used as circuit protection devices and can form an electrical connection between a power source and a component in a circuit to be protected. In particular, a fuse may be configured to protect against damage caused by an overcurrent condition. A fuse can be constructed to physically open or interrupt a circuit path and isolate electrical components from damage upon the occurrence of overvoltage and/or overcurrent conditions in the circuit. Electrical systems in vehicles typically include a number of circuit protection devices to protect electrical circuitry, equipment, and components from damage caused by these conditions.

In many circuit protection applications it is desirable to employ fuses that are compact and that have high "breaking capacities." Breaking capacity (also commonly referred to as "interrupting capacity") is the current that a fuse is able to interrupt without being destroyed or causing an electric arc of unacceptable duration. High-voltage applications require a fuse element (or fuse link) that can handle the energy and arcing associated with an opening of the element of the fuse or circuit. At lower voltages, the arc may not cause serious damage to the metal and plastic portions of the fuse and the fuse housing. However, at higher voltages, extensive damage to the metal and plastic portions of the fuse and its surroundings can occur.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

Various embodiments described herein provide a fuse with improved energy handling and arc quenching characteristics that can be provided in a relatively small package, suitable for the automotive environment.

Various embodiments provide a circuit protection device including a housing having a top section mounted to a bottom section. The circuit protection device can include a first arc barrier extending from the bottom section and a second arc barrier extending from the top section. The top and bottom sections mounted together can define a cavity that can include a spacing between the first arc barrier and the second arc barrier. A first terminal and a second terminal can be secured to the bottom section. A fuse element can be positioned within the housing and can be connected to the two terminals. The fuse element can be positioned to traverse over and/or under the arc barriers. The fuse element or a portion thereof can be surrounded by air. A portion of the cavity can be filled with an arc-quenching material.

BRIEF DESCRIPTION OF THE DRAWINGS

By way of example, specific embodiments of the disclosed device will now be described, with reference to the accompanying drawings, in which.

DETAILED DESCRIPTION

Figure 1A:
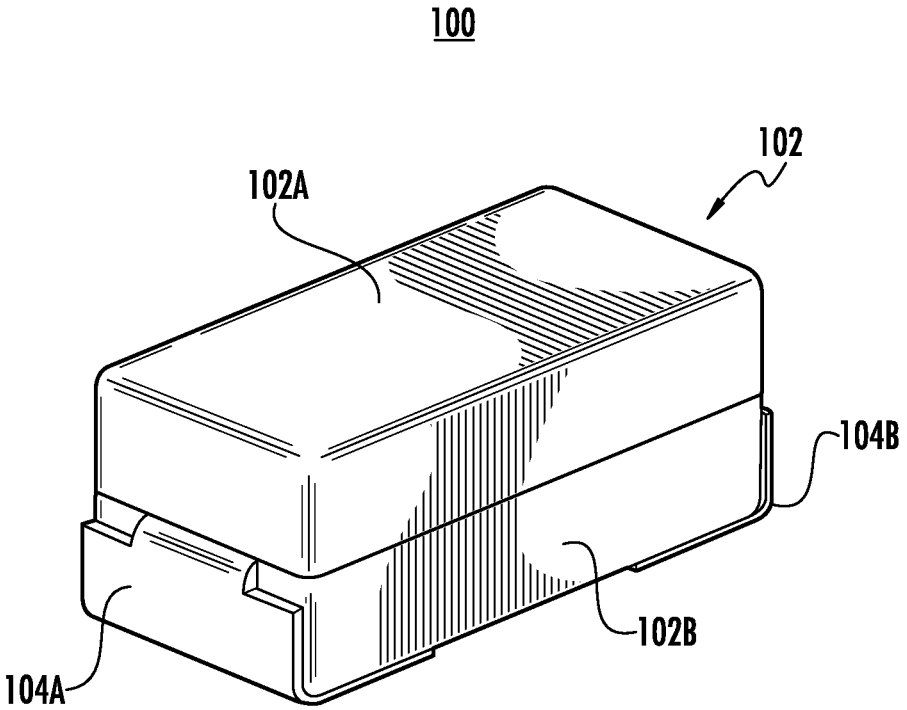
FIG. 1A is a perspective view of an exemplary circuit protection device in accordance with the present disclosure.

The present disclosure will now be described more fully hereinafter with reference to the accompanying drawings, in which preferred embodiments are shown. Circuit protection devices of the present disclosure, however, may be embodied in many different forms and should not be construed as limited to the embodiments set forth herein. Rather, these embodiments are provided so that this disclosure will be thorough and complete, and will fully convey the scope of the invention to those skilled in the art. In the drawings, like numbers refer to like elements throughout.

As described herein, a circuit protection device can include a fuse and can form an electrical connection between a power source and a component in a circuit to be protected. In particular, the fuse may be configured to protect against damage caused by an overcurrent condition and/or an overvoltage condition. The fuse may be constructed to physically open or interrupt a circuit path and isolate electrical components from damage upon the occurrence of specified conditions in the circuit (e.g., overcurrent and/or overvoltage conditions). Upon the occurrence of a specified fault condition, such as an overcurrent condition, a fusible element melts, breaks or otherwise opens to interrupt the circuit path and isolate the protected electrical components or circuit from potential damage. More specifically, the circuit protection device may be a wire in air split fuse with built in arc quencher which includes a housing unit having a cover and a bottom holder. The circuit protection device may include one or more arc barriers with a first arc barrier extending from the housing and a second arc barrier extending from the bottom holder. A fuse element can be wrapped over one arc barrier and under the other arc barrier with terminals connected to the fuse element, secured at either end of the bottom holder. An arc-quenching material may also be included within the housing. In this manner, the first and second arc barriers prevent or reduce arcing between the ends of the fuse element and/or between the terminals to which the fuse element may be connected.

Figure 1B:
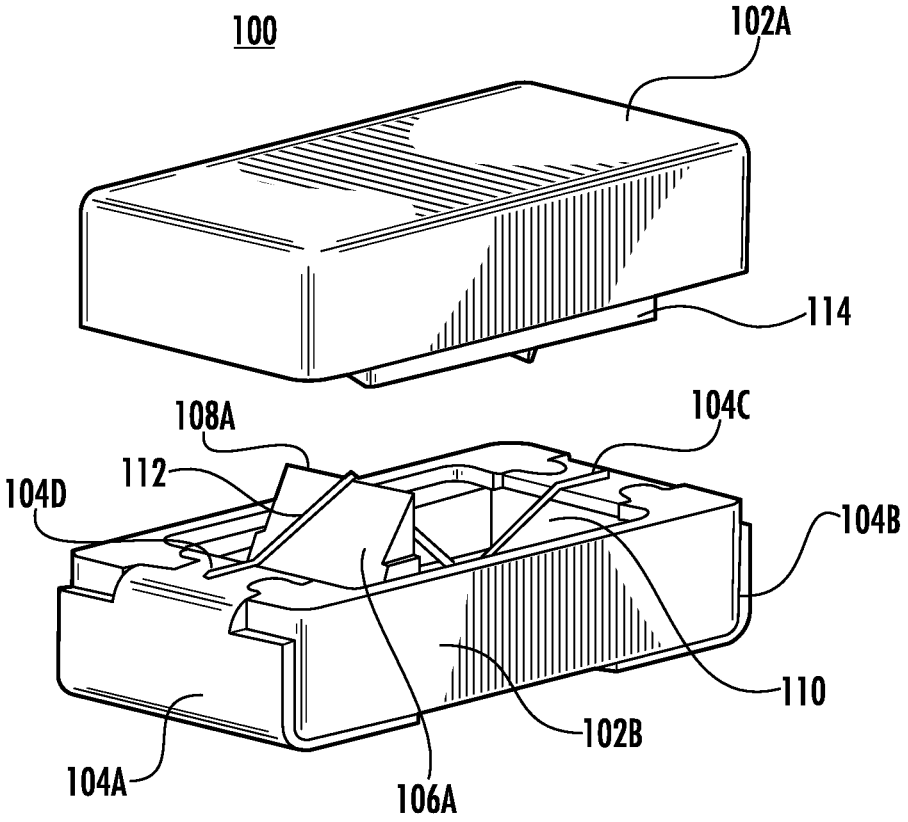
FIG. 1B is a perspective exploded view of the exemplary circuit protection device of FIG. 1A.

FIG. 1A is a perspective view of a circuit protection device 100 in accordance with the present disclosure. FIG. 1B is a perspective exploded view of the exemplary circuit protection device 100 of FIG. 1A. The circuit protection device 100 (e.g., fuse) may include a housing 102 having a top section 102A mounted to a bottom section 102B. The bottom section 102B may be configured in one of a variety of shapes and sizes, such as, for example, a four-sided square and/or a four-sided rectangular shape. The bottom section 102B can include a first arc barrier 106A extending from one or more locations within the bottom section 102B. The top section 102A and the bottom section 102B, when mounted together, can define an open space or cavity 110. In one embodiment, the cavity 110 can include all of the open space in the middle of the housing 102 when the top section 102A is mounted together with the bottom section 102B. More specifically, the cavity 110 may be defined to include several open space sections.

The circuit protection device 100 may include a first terminal 104A and a second terminal 104B. The first terminal 104A and the second terminal 104B can be secured to the bottom section 102B. In one embodiment, the top section 102A may include a second arc barrier (not shown in FIGS. 1A-1B) defined by a wall extending from the top section 102A. The first terminal 104A can include a top section 104D and the second terminal 104B can include a top section 104C as shown in FIG. 1B. In one embodiment, the first terminal 104A and the second terminal 104B may be one of a variety of differently shaped terminals, such as C-shaped terminals or L-shaped terminals, capable of being snapped, molded, bolted, friction fitted, and/or secured via tongue-in-groove onto the bottom section 102B. For example, in one embodiment, the first terminal 104A and the second terminal 104B may snap and/or fit into a receiving end of the bottom section 102B with the tongue or horizontal portion (e.g., the top section 104D, 104C) when the first terminal 104A and the second terminal 104B are assembled onto the bottom section 102B.

In one embodiment, the circuit protection device 100 can include fuse element 112. The fuse element 112 may be positioned between the top section 104D of the first terminal 104A and the top section 104C of the second terminal 104B. The fuse element may have a serpentine shape as it traverses over and/or under at least one arc barrier, such as the first arc barrier 106A. Said differently, the fuse element 112, having a serpentine shape, can traverse at least one arc barrier, such as the first arc barrier 106A, by traversing up and over the at least one arc barrier, such as traversing up and over a peak 108A of the first arc barrier 106A, of the bottom section 102B.

The fuse element 112 may be comprised of nickel, copper, tin, or an alloy or mixture comprising nickel, copper, silver, gold, and/or tin. With some examples, the fuse element 112 may have a thickness between 0.02 and 5 mils (a mil being a thousandth of an inch). The fuse element 112 may comprise a body of metallic material arranged in one of a plurality of geometric configurations. The fuse element 112 may be mounted and/or make contact with the first terminal 104A and the second terminal 104B. The fuse element 112 may be disposed on and electrically connected or coupled to both top sections 104D, 104C of each of the first terminal 104A and the second terminal 104B, respectively. In other words, each end of the fuse element 112 may be disposed on and electrically connected or coupled to both the first terminal 104A and the second terminal 104B. The fuse element 112 can traverse at least one arc barrier, such as the first arc barrier 106A. During an overcurrent condition, the fuse element 112 can melt (or break or split). At least one arc barrier, such as the first arc barrier 106A, can be configured to prevent or reduce arcing upon activation/melting of the fuse element 112.

As shown in FIG. 1B, the top section 102A can include one or more positioning guides 114 (e.g., "weld extensions") so as to more precisely guide, position, and secure placement assembly of the housing unit 102.

Figure 2A:
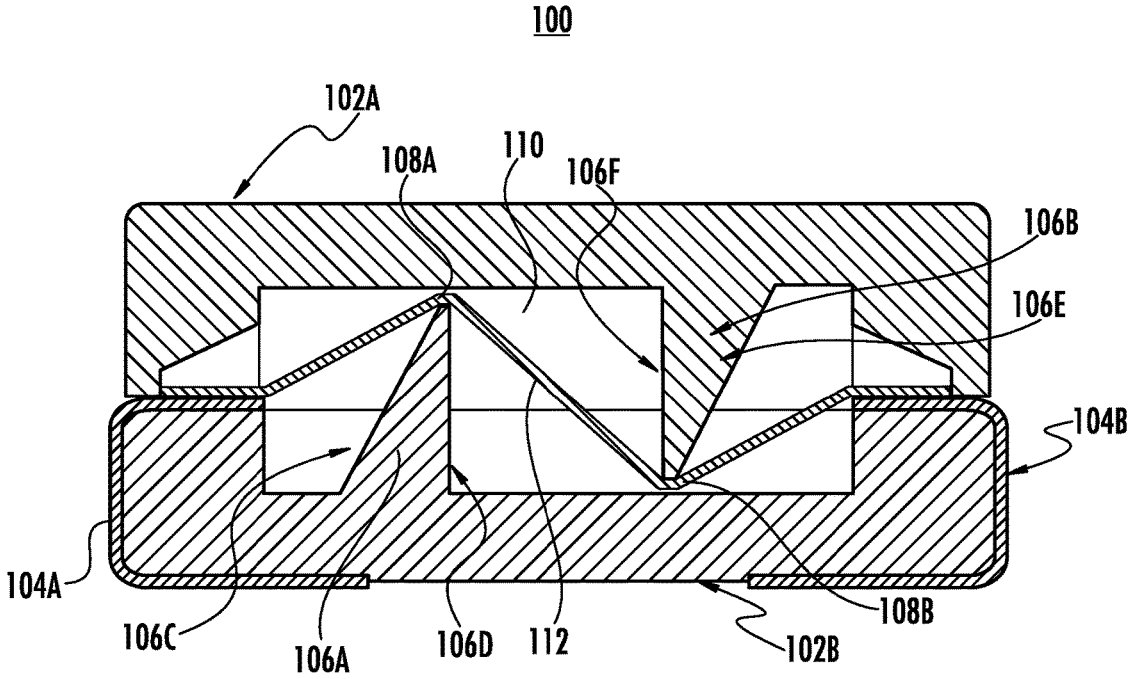
FIG. 2A is a sectional view of the exemplary circuit protection device of FIGS. 1A and 1B.

FIG. 2A is a sectional view of the exemplary circuit protection device 100 in accordance with the present disclosure. The circuit protection device 100 may be a wire in air split fuse with built in arc quencher. As shown, the circuit protection device 100 may include a housing including the top section 102A mounted to the bottom section 102B. The circuit protection device 100 may include a first arc barrier 106A defined by a ramped shaped wall extending from the bottom section 102B. The circuit protection device 100 may also include a second arc barrier 106B also defined by a ramped shaped wall that extends downwardly into the cavity 110 from the top section 102A. The top section 102A and the bottom section 102B mounted together can define the recess or cavity 110 which can include the space between the first arc barrier 106A and the second arc barrier 106B.

As can be seen in FIG. 2A, the top portion 102A of the housing 102 can form an approximately upper one-half of the housing 102 and the bottom portion 102B of the housing 102 can form an approximately lower one-half of the housing 102.

For example, the wall defined by the first arc barrier 106A can include a sloping sidewall and a vertical sidewall opposite the sloping sidewall, and the sloping sidewall and/or the peak 108A can support a first portion of the fuse element 112. The wall defined by the second arc barrier 106B can include a sloping sidewall and a vertical sidewall opposite the sloping sidewall, and the sloping sidewall and/or the peak 108B can support another portion of the fuse element 112.

In one embodiment, the first arc barrier 106A may be molded onto (or formed as part of) the bottom section 102B and the second arc barrier 106B may be molded onto (or formed as part of) the top section 102A. The first arc barrier 106A and the second arc barrier 106B may create a high breaking capacity of greater than 350 volts direct current (VDC). In one embodiment, the first arc barrier 106A and the second arc barrier 106B can be configured to prevent or reduce arcing upon activation of the circuit protection device 100 (e.g., when the fuse element 112 melts or breaks in response to an overcurrent condition).

In one embodiment, the fuse element 112 may be coplanar at each end portion of the fuse element 112 and coupled to and connecting with the first terminal 104A and the second terminal 104B. In one embodiment, all or a portion of the fuse element 112 may be of a serpentine or serpentine-like shape. The fuse element 112 connects to the first terminal 104A and may traverse around and along the first arc barrier 106A and the second arc barrier 106B, such as traversing over one (e.g., over 106A) and under the other (e.g., under 106B) in a different plane to connect the first terminal 104A to the second terminal 104B. Said differently, the fuse element 112 having a serpentine shape may traverse up and over the first arc barrier 106A of the bottom section 102B and down and under the second arc barrier 106B of the top section 102A. The fuse element 112 may include at least 3 sections; one section defined from the first arc barrier 106A to an edge of housing 102 where the top section 102A and the bottom section 102B meet or join, a second section between the first arc barrier 106A and the second arc barrier 106B, and a third section between the second arc barrier 106B and an opposite edge of housing 102 where the top section 102A and the bottom section 102B meet or join. In general, the fuse element 112 can be shaped in any manner to traverse between the first terminal 104A and the second terminal 104B while negotiating around the first and second arc barriers 106A and 106B.

In one embodiment, the portion of the fuse element 112 that is supported by the peak 108A of the first arc barrier 106A and the peak 108B of the second arc barrier 106B may be one of a variety of geometrical configurations, such as a curve or triangle shape. For example, with the first arc barrier 106A defined by the ramped shaped wall extending upwardly from the bottom section 102B, the fuse element 112 traverses horizontally from the first terminal 104A and then changes directions moving diagonally upward and over the first arc barrier 106A. The portion of the fuse element 112 that is supported by the peak 108A may be a triangle shape so as to allow the fuse element 112 to reverse directions. The fuse element 112 then diagonally traverses downward through a portion of the cavity 110 and down and under the second arc barrier 106B. The portion of the fuse element 112 that is supported by the peak 108B may be a triangle shape so as to allow the fuse element 112 to reverse directions. The fuse element 112 reverses direction at the peak 108B and diagonally traverses upward and then traverses horizontally to the second terminal 104B. The fuse element 112 can be coplanar at one end connected and coupled to the first terminal 104A and the opposite end connected and coupled to the second terminal 104B. Also, the fuse element 112 may connect and/or rest upon the peak 108A of the first arc barrier 106A and/or connect and/or rest upon the peak 108B of the second arc barrier 106B.

The cavity 110 may be defined to include several chambers (e.g., parts), such as a first chamber, a second chamber, and/or a third chamber. The first chamber may be the open space of the cavity 110 between one end of the top section 102A and the bottom section 102B and the first arc barrier 106A. The second chamber may be defined as the open space of the cavity 110 between the first arc barrier 106A and the second arc barrier 106B. The third chamber may be defined as the open space of the cavity 110 between the second arc barrier 106B and another end of the top section 102A and the bottom section 102B.

The fuse element 112 can traverse through all or a portion of the cavity 110. In one embodiment, the cavity 110 can provide for all or a portion of the fuse element 112 to be surrounded by air. Also, in order to prevent, reduce, or minimize arcing, all or a portion of the cavity 110 may be filled with a filler that minimizes the likelihood of arcing. For example, the filler can be an arc-quenching material. The arc-quenching material may assist with at least one arc barrier, such as the first arc barrier 106, in preventing an arcing between the ends of the fuse element 112 and/or between terminals 104A, 104B. The arc-quenching material can be an inorganic, dry, granular, nonconductive material. Examples include quartz sand, silica, ceramic powders, and calcium sulfate. This material is preferably placed into the housing before the housing is closed. Said, differently, an arc quenching material may be injected into the cavity 110 as the bottom section 102B is connected to the top section 102A. As an example, the first part and the third part of the cavity 110 may include the arc quenching material. In an alternative configuration, the first part, the second part, and/or the third part of the cavity 110 may include the arc quenching material.

Figure 2B:
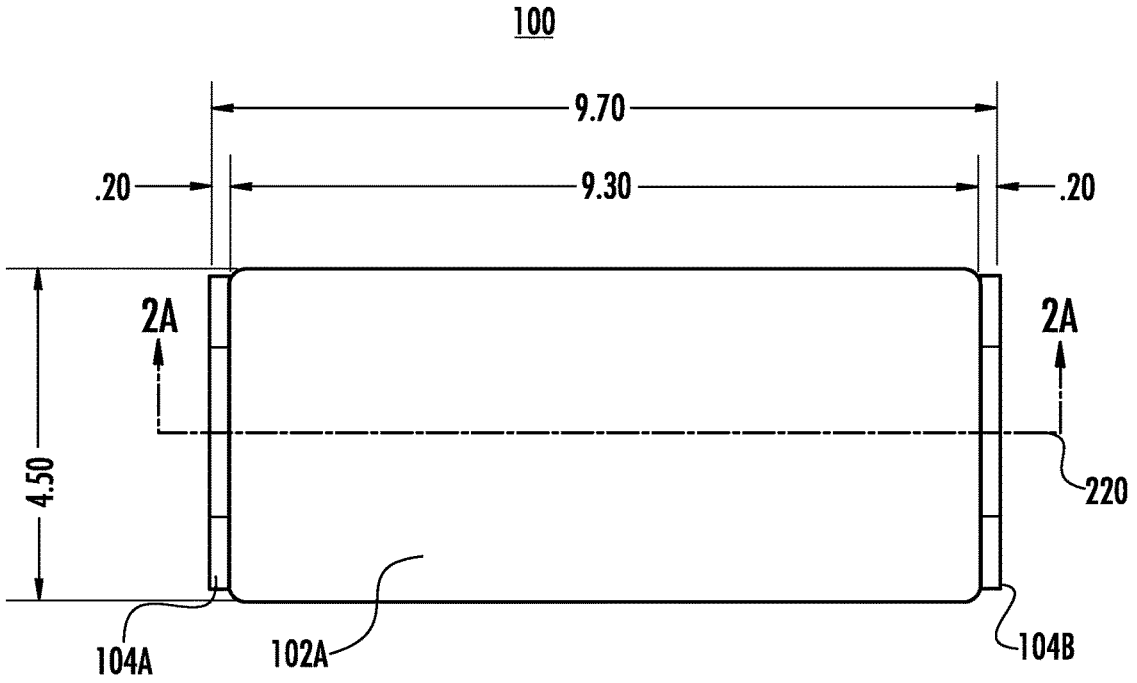
FIG. 2B is a top view illustrating dimensions of the exemplary circuit protection device depicted in FIG. 2A.

FIG. 2B is a top view illustrating exemplary dimensions of the housing unit 102 of the circuit protection device 100 in accordance with the present disclosure. It should be noted the housing unit 102 may be one of a variety of geometric shapes and sizes and FIG. 2B illustrates exemplary dimensions for a length and a width for one embodiment of the housing unit 102. FIG. 2B illustrates a top view of the circuit protection device shown in FIG. 2A. In particular, FIG. 2B illustrates a view looking down on the top section 102A of the housing unit 102. Element 220 shows a direction of the view depicted in FIG. 2A. The exemplary dimensions shown in FIG. 2B can be provided in units of millimeters (mm).

Figure 3A:
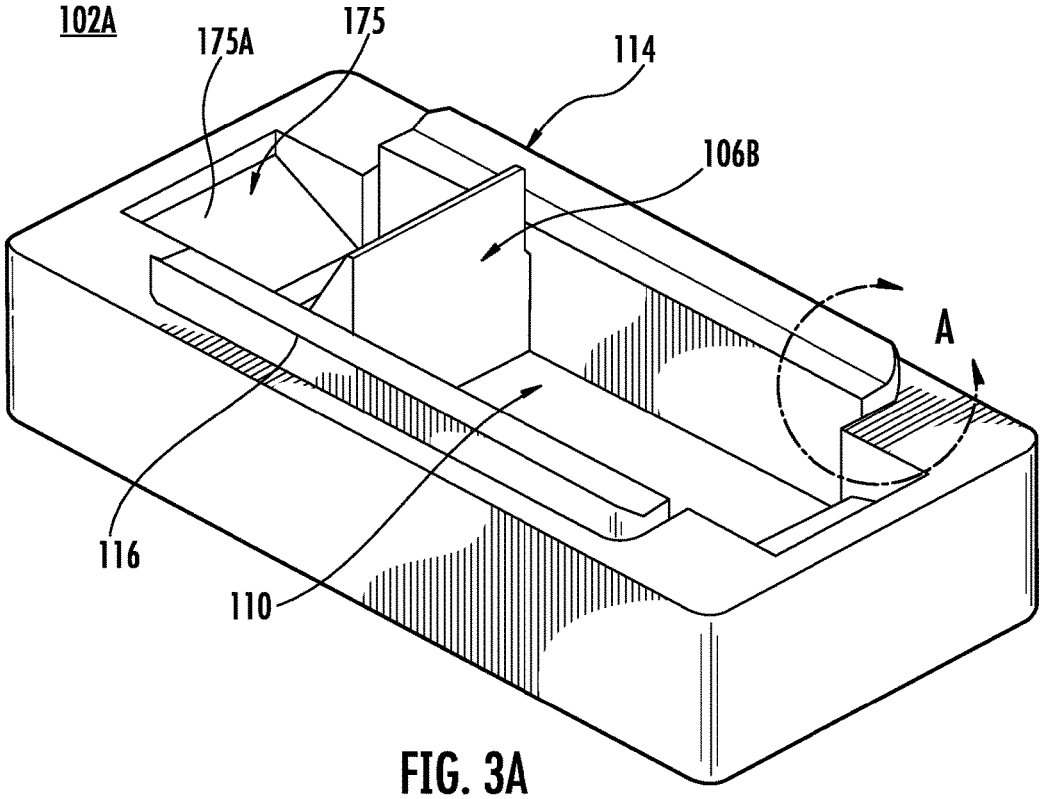
FIG. 3A is a perspective view of a top section of a circuit protection device in accordance with the present disclosure.

FIG. 3A is a perspective view of the top section 102A of the circuit protection device 100 in accordance with the present disclosure. The top section 102A may include various internal designs and configurations for allowing the fuse element 112 to traverse the cavity 110 and the first arc barrier 106A and the second arc barrier 106B. Also, each side of the top section 102A may include at least one secondary chamber 175 having a ramped face and/or a slanted portion (for purposes of illustration, only one of these secondary chambers 175 is shown but an additional secondary chamber can be positioned on the opposite end of top section 102A). In one embodiment, the at least one secondary chamber 175 defines a slanted ramp-like cavity for providing solder relief. Each secondary chamber 175 may be located on each opposing end of the top section 102A. In one embodiment, when the top section 102A is mounted to the bottom section 102B, the at least one secondary chamber 175 can be directly disposed over a top portion of one of the terminals 104A or 104B (e.g., top section 104C or 104D).

The top section 102A can also include one or more positioning guides 114, 116 (e.g., "weld extensions") so as to aid placement of the top section 102A onto the bottom section 102B of the housing unit 102. It should be noted that the top section 102A and the bottom section 102B collectively form the housing unit 102.

Figure 3B:
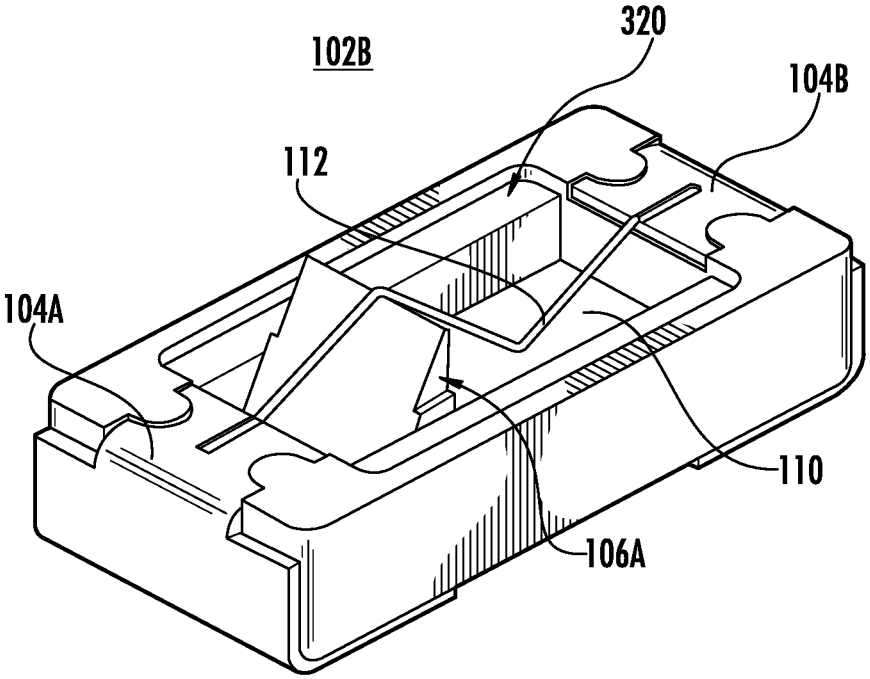
FIG. 3B is a perspective view of a bottom section of a circuit protection device in accordance with the present disclosure.

FIG. 3B is a perspective view of the bottom section 102B of the circuit protection device 100 in accordance with the present disclosure. The bottom section 102B provides for receiving the fuse element 112. The fuse element 112 may comprise a body of metallic material arranged in one of a plurality of geometric configurations mounted within the top section 102A and the bottom section 102B of the housing unit 102, extending up and/or around the first arc barrier 106A and down and/or around the second arc barrier 106B. The first terminal 104A and the second terminal 104B may be formed of any suitable electrically conductive material, such as copper or tin. The conductive materials may be decided based on desired fusing characteristics and/or durability.

The fuse element 112 may electrically be connected to the first terminal 104A and the second terminal 104B by, for example, soldering. For example, a first end of the fuse element 112 may connect to the first terminal 104A and a second end of the fuse element 112 may connect to the second terminal 104B as depicted in FIG. 3B. At least one or more portions (such as each end) of the fuse element 112 may be coplanar with the first terminal 104A and the second terminal 104B. As illustrated in FIG. 3B, at least a portion of the first terminal 104A and the second terminal 104B wrap around and into the bottom section 102B. The fuse element 112 is disposed at one of a variety of locations, such as a center location, on a top portion of the first terminal 104A and the second terminal 104B and soldered thereto. At least a portion of each end of the fuse element 112 may be supported by the first terminal 104A and the second terminal 104B to prevent bending or sagging while allowing another portion of the fuse element 112 to traverse through the cavity 110 and be surrounded by air.

Figure 3C:
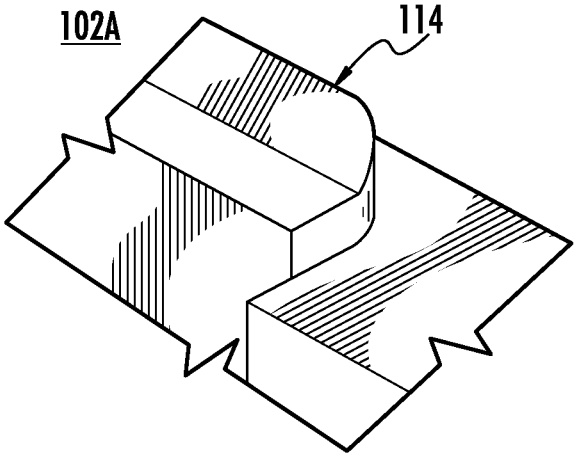
FIG. 3C is a perspective view of a positioning guide and weld extension of a top section of the circuit protection device depicted in FIG. 3A in accordance with the present disclosure.

FIG. 3C is a perspective view of a positioning guide and weld extension 114 of the top section 102A of a circuit protection device 100 in accordance with the present disclosure. The positioning guides 114, 116 can function as an energy director for ultrasonic welding. In one embodiment, the energy director (e.g., the positioning guides 114, 116) can be material in the form of a ridge or bump, extending slightly above the surface of the outer, surrounding area of the top section 102A and contacting the surface(s) to be welded. The energy director may be molded on the surface of the top section 102A. The top section 102A may be in direct contact with the surface of the top section 102A to be ultrasonically welded. During an ultrasonic welding process, the positioning guides 114, 116 are first melted or fused as a result of the friction created between the top section 102A and the bottom section 102B to be welded by the ultrasonic vibrations. In one embodiment, melting or fusing can occur proximate the locations of the positioning guides 114, 116 of the top section 102A and the bottom section 102B. Once bonded and cooled, these locations can be solidified and can seal the bottom section 102B to the top section 102B.

A portion of the positioning guides 114 and 116 can be considered to be mounting extensions. The mounting extensions 114 and 116 can aid in the placement and alignment of the top section 102A onto the bottom section 102B during assembly. Further, the bottom section 102B can include a recessed portion 320. The recessed portion 320 can be positioned on opposite lateral sides of the bottom section 102B. The recessed portion 320 can be positioned within an inner perimeter of the bottom section 102B. The recessed portion 320 can be positioned and shaped to mate and align with the portion of the mounting extensions 114 and 116 when the top portion 102A is positioned on top of the bottom portion 102B as shown in FIGS. 3A and 3B. Together, the recessed portion 320 and the mounting extensions 114 and 116 can ensure an aligned and secure fit between the top portion 102A and the bottom portion 102B prior to sealing.

Figure 4:
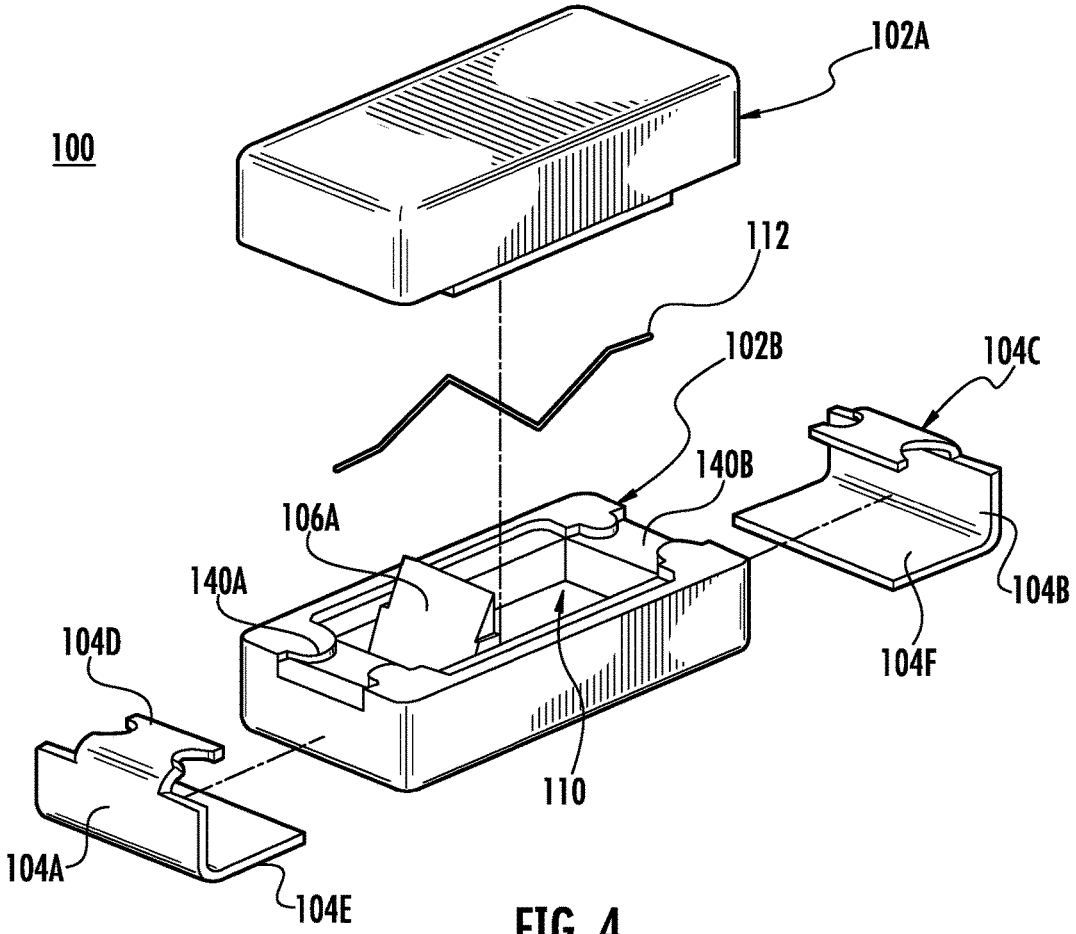
FIG. 4 is a perspective exploded view of components of an exemplary circuit protection device in accordance with the present disclosure.

FIG. 4 is an exploded perspective view of components of the exemplary circuit protection device 100 in accordance with the present disclosure. The top portion or cover 102A can be formed from any variety of materials including Ultramid TKR4365G5. The bottom portion 102B can also be formed from any variety of materials including Ultramid TKR4365G5. The terminals 104A and 104B, as an example, can be formed of tin platted copper. The fuse element, in one embodiment, can be formed from a copper alloy.

In one embodiment, the bottom section 102B is disposed beneath the top section 102A. The fuse element is disposed over the bottom section 102B and underneath the top section 102A. On each side of the bottom section 102B, the first terminal 104A and the second terminal 104B are secured thereto.

In one embodiment, the first terminal 104A and the second terminal 104B each may be one of a variety of geometric configurations, such as c-shaped. In one embodiment, the first terminal 104A and the second terminal 104B being c-shaped can wrap around opposite ends of the bottom section 102B. For example, the first terminal 104A and the second terminal 104B may have a c-shape and can extend into a top edge of the bottom section 102B and/or wrap around a lower edge of the bottom section 102B. The first terminal 104A may have a top edge 104D that may bend, extend and/or wrap around a top edge of a bottom section 102B for receiving the fuse element 112. The top edge 104D is then secured, coupled, and/or connected to the bottom section 102B. The first terminal 104A may also have a bottom edge 104E. The bottom edge 104E can be connected and/or secured to the bottom section 102B. The bottom edge 104E may traverse along a portion of the bottom section 102B and/or bend, extend and/or wrap around a bottom edge of the bottom section 102B. In one embodiment, the top edge 104D and the bottom edges 104E may be orthogonal to a portion of the first terminal 104A, thus forming the substantially C-shape, and secured into at least a portion of the bottom section 102B. The top edge 104D and the bottom edge 104E may be connected by a section of the first terminal 104A that wraps around the bottom section 102B.

In one embodiment, the second terminal 104B may have the top edge 104C that may bend, extend and wrap around a top edge of a bottom section 102B for receiving the fuse element 112. The top edge 104C is then secured, coupled, and/or connected to the bottom section 102B. The second terminal 104B may also have a bottom edge 104F. The bottom edge 104F is connected and/or secured to the bottom section 102B. The bottom edge 104F may traverse along a portion of the bottom section 102B and/or bend, extend and wrap around a bottom edge of the bottom section 102B. In one embodiment, the top edge 104C and the bottom edges 104F may be orthogonal to a portion of the second terminal 104B, thus forming the substantially c-shape, and secured into at least a portion of the bottom section 102B. The top edge 104C and the bottom edge 104F may be connected by a section of the second terminal 104B that wraps around the bottom section 102B. After assembly, the top edges 104C and 104D may be positioned between the top portion 102A and the bottom portion 102B of the housing 102.

In one embodiment, the circuit protection device 100 may be fabricated in two parts, such as a cover (e.g., the top section 102A) and housing (e.g., the bottom section 102B). After the first terminal 104A and the second terminal 104B are connected, and the fuse element 112 is connected, it may be necessary to close the fuse. The two parts (e.g., the top section 102A and the bottom section 102B) of the circuit protection device 100 may be closed in many ways.

In one embodiment, when using plastic parts, assembly may include placing the top section 102A over the bottom section 102B and sealing the top section 102A to the bottom section 102B by ultrasonic welding. An alternative approach can include plastic welding the parts (e.g., the top section 102A and the bottom section 102B) together, such as by running a bead of polypropylene "welding" bead around the split line between the parts. The positioning guides 114 (see FIGS. 1-3) can function as an energy director for ultrasonic welding. The parts may also use an adhesive for joining, or they may use the technique of solvent bonding, in which a solvent that melts both parts is placed on one side or the other or both, and the parts are pressed together. As shown in some of the embodiments above, the parts may be equipped with features for a friction fit, such as matching tongue- and groove features or snap fit features, such as male and female snap-fit portions. Any suitable means for closing and securing may be used.

As more clearly illustrated in FIG. 4, the bottom section 102B can include at least one receiving means 140A/140B designed as a matching tongue- and groove feature or snap fit feature for receiving the first terminal 104B and the second terminal 104B. Said differently, the receiving means on the bottom section can be a matching tongue- and groove feature and/or a snap fit feature for receiving a first section 104D of the first terminal 104A and the first section 104C of the second terminal 104B.

In one embodiment, the bottom section 102B and the top section 102A may be a molded plastic part, with the internal walls and with the openings in the internal and external walls for receiving the first terminal 104A and the second terminal 104B.

Also, it should be noted that in one embodiment the top section 102A and the bottom section 102B can be made of made of a variety of polyamides, such as Ultramid TKR4365G5. The first terminal 104A and the second terminal 104B may be made of one of a variety of conductive materials, such as, for example, tin plated copper. Additionally, the fuse element 112 may be made of a copper alloy.

Figure 5:
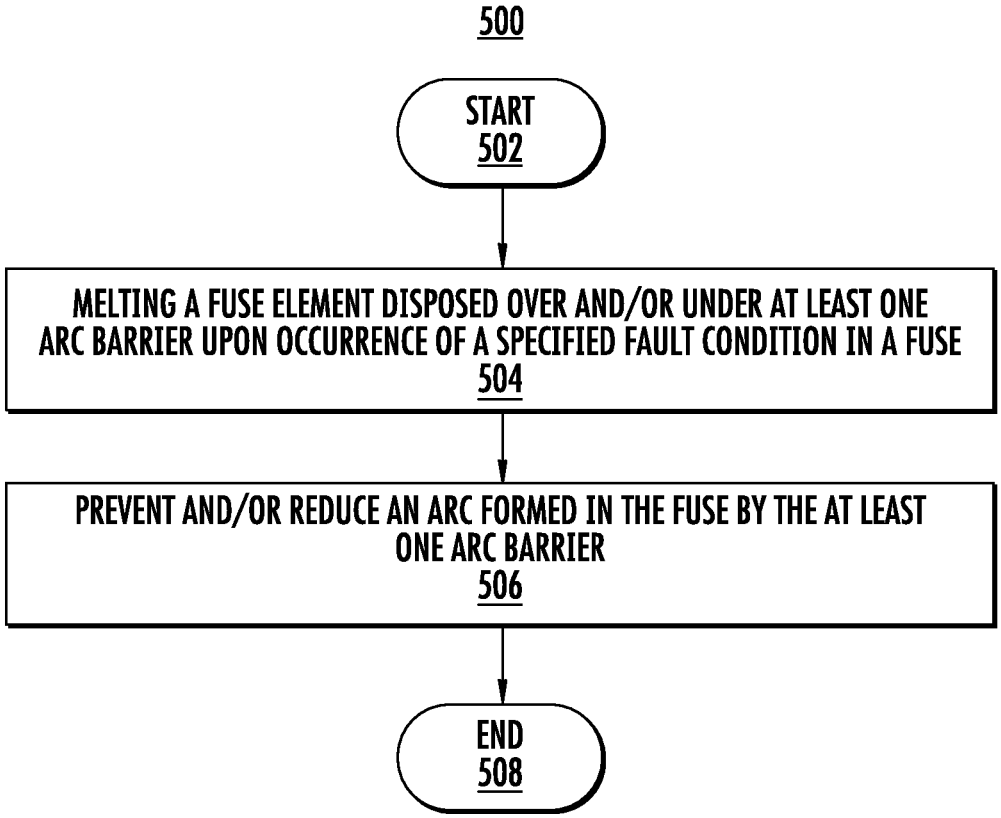
FIG. 5 illustrates a flow diagram of an embodiment of a method of operation of a circuit protection device in accordance with the present disclosure.

FIG. 5 illustrates a flow diagram of an embodiment of a method of operation 500 of a circuit protection device in accordance with the present disclosure. The method of operation 500 can be applied to the circuit protection device 100 as described herein. The method of operation 500 begins at block 502. The method of operation 500 moves to block 504. At block 504, a fuse element disposed over and/or under at least one arc barrier (e.g., the first arc barrier 106A and/or the second arc barrier 106B) is melted (or broken or split or otherwise activated) upon occurrence of a specified fault condition in a fuse. The method of operation 500 prevents and/or reduces an arc formed during the opening of the fuse by the at least one arc barrier (e.g., the first arc barrier 106A and/or the second arc barrier 106B) at block 506. The method of operation 500 may end at block 508.

Figure 6:
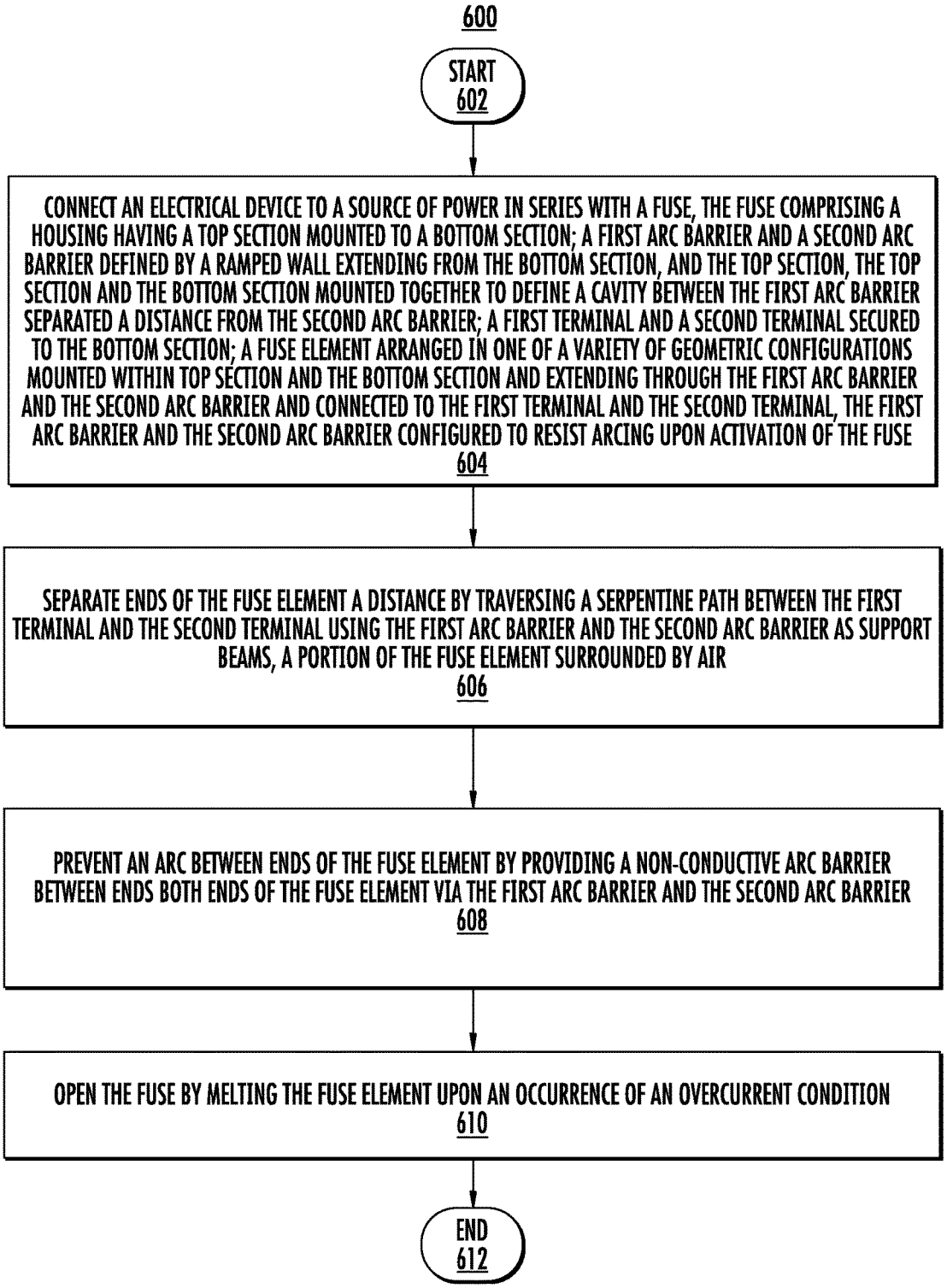
FIG. 6 illustrates a flow diagram of an additional embodiment of a method of operation of a circuit protection device in accordance with the present disclosure.

FIG. 6 illustrates a flow diagram of an embodiment of a method of operation 600 of a circuit protection device in accordance with the present disclosure. The method of operation 600 can be applied to the circuit protection device 100 as described herein. The method of operation 600 begins at block 602. The method of operation 600 moves to block 604. At block 604, an electrical device is connected to a source of electrical power in series with a fuse at block 604, wherein the fuse comprises a housing having a top section mounted to a bottom section. The fuse can further include a first arc barrier defined by a wall extending from the bottom section. A second arc barrier can be defined by a wall extending from the top section, the top section and the bottom section mounted together to define a recess or cavity between the first arc barrier separated a distance from the second arc barrier. A first terminal and a second terminal are secured to the bottom section. A fuse element comprises a body of metallic material arranged in one of a plurality of geometric configurations mounted within the top section and the bottom section (e.g., a bottom holder or bottom housing) of the housing, extending through the first arc barrier and the second arc barrier and connected to the first terminal and the second terminal. The first arc barrier and the second arc barrier configured to resist arcing upon activation of the fuse. The method of operation 600 separates ends of the fuse element a particular minimum distance by traversing a serpentine path between two terminals and using the first arc barrier and the second arc barrier as support beams, a portion of the fuse element extending from the first arc barrier to the second arc barrier surrounded by air at block 606. The method of operation 600 prevents an arc between ends of the fuse element by providing a non-conductive arc barrier between the ends of the fuse element via the first arc barrier and the second arc barrier such that the first arc barrier and the second arc barrier completely blocks a direct path of the fuse element at block 608. The method of operation 600 at block 610 opens the fuse by melting (or breaking or splitting) the fuse element upon an overcurrent condition occurring at block 610. The method of operation 600 may end at block 612.

Figure 7:
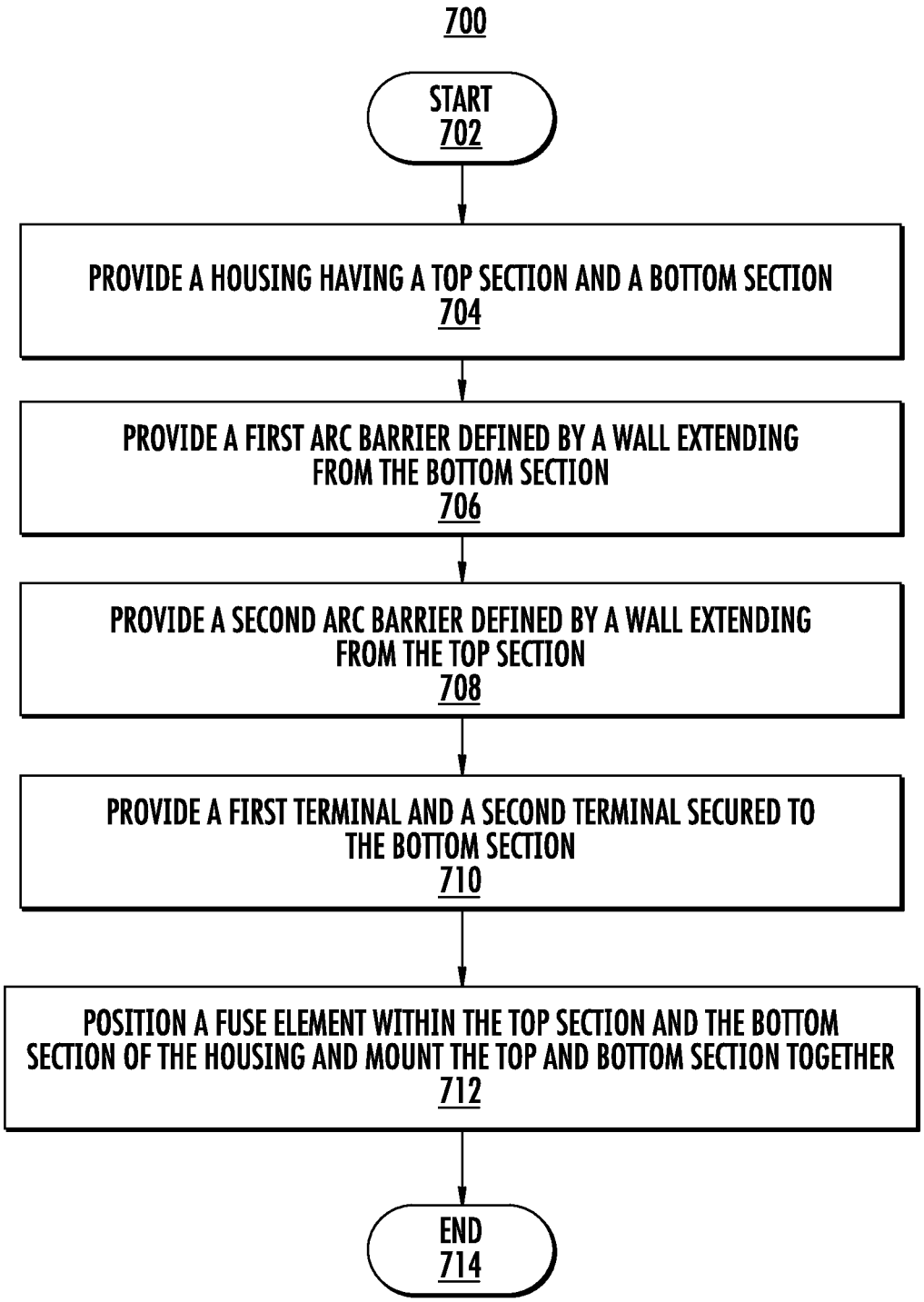
FIG. 7 illustrates a flow diagram of an embodiment of a method of manufacturing a circuit protection device in accordance with the present disclosure.

FIG. 7 illustrates a flow diagram of an embodiment of the method of manufacturing 700 an electrical circuit protection device in accordance with the present disclosure. In one embodiment, the method of manufacturing 700 may be used to form the circuit protection device 100. The method of manufacturing 700 begins at block 702. The method of manufacturing 700 moves to block 704. At block 704, a housing having a top section and a bottom section is provided. At block 706, a first arc barrier defined by a wall extending from the bottom section is provided. At block 708, a second arc barrier defined by a wall extending from the top section is provided, the top section and the bottom section mounted together to define a recess or cavity between the first arc barrier separated a distance from the second arc barrier. At block 710, a first terminal and a second terminal secured to the bottom section is provided. At block 712, a fuse element comprising a body of metallic material arranged in one of a plurality of geometric configurations mounted within the top section and the bottom section of the housing is provided. The fuse element extends through the first arc barrier and the second arc barrier and can be connected to the first terminal and the second terminal, wherein the first arc barrier and the second arc barrier can be configured to resist arcing upon activation of the fuse and the fuse element is configured so that when an overcurrent condition occurs, the fuse element melts. At block 712, the fuse element can be soldered to the first and second terminals. After doing so, the top section and the bottom section of the housing can be mounted (e.g., by sealing the two portions together). The method of manufacturing 700 ends at block 714.

While the present disclosure has been disclosed with reference to certain embodiments, numerous modifications, alterations and changes to the described embodiments are possible without departing from the sphere and scope of the present disclosure, as defined in the appended claims. Accordingly, it is intended that the present disclosure not be limited to the described embodiments, but that it has the full scope defined by the language of the following claims, and equivalents thereof.

It is emphasized that the Abstract of the Disclosure is provided to allow a reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate embodiment. In the appended claims, the terms "including" and "in which" are used as the plain-English equivalents of the respective terms "comprising" and "wherein," respectively. Moreover, the terms "first," "second," "third," and so forth, are used merely as labels, and are not intended to impose numerical requirements on their objects.

What has been described above includes examples of the disclosed architecture. It is, of course, not possible to describe every conceivable combination of components and/or methodologies, but one of ordinary skill in the art may recognize that many further combinations and permutations are possible. Accordingly, the novel architecture is intended to embrace all such alterations, modifications and variations that fall within the spirit and scope of the appended claims.

The invention claimed is:

1. A fuse, comprising:

a housing having a top section mounted to a bottom section;

a first arc barrier defined by a first wall extending from the bottom section;

a second arc barrier defined by a second wall extending from the top section, the top section and the bottom section mounted together to define a cavity within the housing;

a first terminal and a second terminal secured to the bottom section; and a fuse element comprising a body of metallic material arranged in one of a plurality of geometric configurations mounted within the top section and the bottom section of the housing, the fuse element traversing around the first arc barrier and the second arc barrier and connected to the first terminal and the second terminal, wherein the first arc barrier and the second arc barrier resist arcing upon activation of the fuse and the fuse element melts when an overcurrent condition occurs;

wherein each of the first and second terminals has grooves formed in opposing sides thereof, and wherein the bottom section includes tongue portions formed in a top edge thereof, the tongue portions disposed within the grooves.

2. The fuse of claim 1, wherein the first wall of the first arc barrier extends perpendicularly from the bottom section.

3. The fuse of claim 2, wherein the first wall of the first arc barrier includes a sloping sidewall and a vertical sidewall, wherein a peak of the first arc barrier supports a portion of the fuse element.

4. The fuse of claim 1, wherein the second wall of the second arc barrier extends perpendicularly from the top section.

5. The fuse of claim 4, wherein the second wall of the second arc barrier includes a sloping sidewall and a vertical sidewall, wherein a peak of the second arc barrier supports a portion of the fuse element.

6. The fuse of claim 1, wherein the first terminal is mounted on a first end of the bottom section.

7. The fuse of claim 6, wherein the first terminal wraps around the first end and is secured to a top portion and a bottom portion of the bottom section.

8. The fuse of claim 6, wherein the second terminal is mounted on a second end of the bottom section.

9. The fuse of claim 8, wherein the second terminal wraps around the second end and is secured to a top portion and a bottom portion of the bottom section.

10. The fuse according to claim 1, further comprising an arc-quenching filler material inside the cavity of the housing.

11. The fuse according to claim 1, wherein a portion of the fuse element is surrounded by air.

12. The fuse of claim 1, wherein the bottom section further comprises a recessed portion for receiving the top section.

13. The fuse of claim 12, wherein the recessed portion is positioned around an inner perimeter of the bottom section.

14. The fuse according to claim 12, wherein the top section further comprises a mounting extension positioned within the recessed portion of the bottom section.

15. The fuse according to claim 1, wherein a spacing between the first arc barrier and the second arc barrier forms a portion of the cavity of the housing.

16. A fuse, comprising:

a housing having a bottom section and a top section;

first and second terminals secured to each end of the bottom section, a first portion of each terminal extending into an interior of the bottom section and a second portion of each terminal wrapping around an exterior of the bottom section;

a first ramped arc barrier extending from the bottom section and a second ramped arc barrier extending from the top section; and a fuse element connected between the first and second terminals and traversing a serpentine path between the first and second terminals and using the two ramped arc barriers as support beams, a portion of the fuse element extending from the first ramped arc barrier to the second ramped arc barrier surrounded by air;

wherein each of the first and second terminals has grooves formed in opposing sides thereof, and wherein the bottom section includes tongue portions formed in a top edge thereof, the tongue portions disposed within the grooves.

17. The fuse of claim 16, wherein a cavity is formed between the top section and the bottom section.

18. The fuse of claim 17, wherein the cavity includes a first portion between a first terminal and the first arc barrier, a second portion between the first and second arc barriers, and a third portion between the second arc barrier and the second terminal.

19. An apparatus, comprising:

a bottom portion of a housing;

a top portion of the housing;

a first arc barrier extending upward from an inside surface of the bottom portion of the housing;

a second arc barrier extending downward from an inside surface of the top portion of the housing;

a cavity formed between the top and bottom portions of the housing and inside the housing, the first and second arc barriers positioned within the cavity;

a first terminal wrapped around a first end of the bottom portion of the housing;

a second terminal wrapped around a second end of the bottom portion of the housing; and a fuse element coupled to an upper terminal portion of the first terminal and coupled to an upper terminal portion of the second terminal, the fuse element positioned over the first arc barrier and under the second arc barrier, wherein the upper terminal portions of the first and second terminals are positioned between the top and bottom portions of the housing, wherein the top portion of the housing forms an approximately upper half of the housing and the bottom portion of the housing forms an approximately lower half of the housing, wherein the top portion of the housing further comprises a first open area positioned over the upper terminal portion of the first terminal approximate the coupling of the fuse element to the upper terminal portion of the first terminal and a second open area positioned over the upper terminal portion of the second terminal approximate the coupling of the fuse element to the upper terminal position of the second terminal;

wherein each of the first and second terminals has grooves formed in opposing sides thereof, and wherein the bottom portion of the housing includes tongue portions formed in a top edge thereof, the tongue portions disposed within the grooves.

* * * * *